US005500094A

United States Patent [19]

Fruchtbaum et al.

[11] Patent Number: 5,500,094

[45] Date of Patent: Mar. 19, 1996

[54] COKE DRUM DEHEADING DEVICE

[75] Inventors: Joseph Fruchtbaum; Dave P. McConathy; Daniel J. Quintana, all of Houston; Harold D. Sloan, Tomball, all of Tex.

[73] Assignee: The M. W. Kellogg Company, Houston, Tex.

[21] Appl. No.: 268,754

[22] Filed: Jun. 30, 1994

[51] Int. Cl.[6] ..... C10B 33/00; C10B 43/00

[52] U.S. Cl. ..... 202/241; 49/249; 202/248; 202/262; 202/270; 248/654; 414/216; 414/401; 414/684.3

[58] Field of Search ..... 15/93.2; 202/262, 202/241, 248, 270, 266; 414/684.3, 584, 401, 212, 216; 49/249, 253, 246; 248/654; 201/2

[56] References Cited

U.S. PATENT DOCUMENTS

| | | | |
|---|---|---|---|
| 3,910,431 | 10/1975 | Fuller et al. | 202/263 |
| 4,003,802 | 1/1977 | Pries | 202/241 |
| 4,107,001 | 8/1978 | Kinzler | 201/2 |
| 4,153,515 | 5/1979 | Gregor et al. | 202/241 |
| 4,233,119 | 11/1980 | Meyers et al. | 202/241 |
| 4,248,562 | 2/1981 | Tsuzuki et al. | 202/241 |
| 4,276,121 | 6/1981 | Rogers | 202/241 |
| 4,515,660 | 5/1985 | Kwasnik et al. | 201/2 |
| 4,726,109 | 2/1988 | Malsbury et al. | 29/402.08 |
| 4,960,358 | 10/1990 | Di Giacomo et al. | 414/684.3 |
| 5,228,825 | 6/1993 | Fruchtbaum et al. | 414/684.3 |
| 5,294,157 | 3/1994 | Smith et al. | 292/25 |

FOREIGN PATENT DOCUMENTS

| | | | |
|---|---|---|---|
| 89307539 | 7/1989 | European Pat. Off. . | |
| 2150494 | 4/1973 | France | 202/241 |
| 1293194 | 2/1987 | U.S.S.R. | 202/241 |

OTHER PUBLICATIONS

Nagy et al., *Oil & Gas Journal*, pp. 77–80, May 29, 1989.

Hahn & Clay *FACT Closure Installation, Operation, and Maintenance Manual*, May 1991.

*Primary Examiner*—Virginia Manoharan

*Attorney, Agent, or Firm*—The M. W. Kellogg Company

[57] ABSTRACT

A vessel unheading device and method especially suited to handle shot coke produced in a delayed coker unit of a petroleum refining process. The device includes a car having mounted thereon one or more bottom head retracting support members which can be laterally positioned below the head assembly. The support member includes a vertically retractable member suitable for elevating a bearing plate mounted at an upper end thereof into pivotable load bearing engagement with the head, and a horizontally retractable member having one end attached to the bearing plate and another end attached to the vertically retractable member for applying a pivot force. Shot coke or other debris is captured from the opened vessel by a mobile chute wheeled into position adjacent the unheading car. Following complete retraction, the head is transported to a remote location for maintenance.

12 Claims, 4 Drawing Sheets

COKE DRUM DEHEADING DEVICE

FIELD OF THE INVENTION

The present invention relates to a device for removing a bottom head from a vessel which may contain a fluid or unconsolidated debris, and more particularly to a device and method for unheading a coke drum which may contain shot coke.

BACKGROUND OF THE INVENTION

In the typical delayed coking process, high boiling petroleum residues are fed to a large upright vessel, called a coke drum, where they are thermally cracked into light products and a solid residue— petroleum coke. When the drum is full, the feed is diverted to an empty drum and the coke-filled drum is steam purged and cooled with quench water. The drum is then drained of water, and the top and bottom heads are removed to allow the coke to be cut from the drum by high pressure water jets. After the coke is removed, the heads are replaced and the coke drum is readied to be placed back into service to repeat the cycle.

The delayed coker unit has generally been operated at a lower than optimum efficiency to ensure the formation of sponge coke because sponge coke accumulates on the walls of the drum where it is supported when the bottom head is removed. To maximize performance, refinery operators are increasingly using lower grade feedstocks which increase the prevalence of shot coke production. With a pellet-like consistency, shot coke is not supported by the walls of the coke drum. As a result, shot coke produces a large load on the bottom head and makes the head more difficult to remove. In addition, the coke can fall out of the vessel as the bottom head is opened and pose a hazard to personnel and equipment in the immediate vicinity.

To minimize this hazard, numerous attempts have been made to make the head removing operation in a decoking process increasingly automated to reduce the presence of maintenance personnel and equipment near the drum. Nagy et al., *Oil & Gas Journal*, pp. 77–80, May 29, 1989 and EP Application No. 89-307,539, for example, describe a head operating mechanism which is said to improve delayed coker safety and efficiency. After the bolts are removed manually, hydraulic cylinders can be remotely activated to swing the head open on a hinge to allow access for coke removal. However, a hinged head cannot be withdrawn for maintenance work, i.e. cleaning and gasket replacement, until the decoking operation has been completed. Personnel must service the head under the opened drum from which debris can fall. In addition, extensive vessel fabrication work must be undertaken to retrofit existing coker drums, i.e. the hinge must be installed on the bottom flange.

U.S. Pat. Nos. 4,726,109 to Malsbury et al. and 4,960,358 to DiGiacomo et al. describe a remote unheading device for coking drums. The device includes a head unit for attachment to a lower flange of a coking drum and a plurality of swing bolts which are disconnected by remotely operated detensioning equipment. A platform device lowers the head unit, moves it laterally to one side and tips it for cleaning. A chute attached to the frame can be raised into engagement with the coking drum lower flange for removal of coke from the drum. Although remotely operable, shot coke presents a problem since the chute cannot be engaged until the head has been completely withdrawn. Installation of this device on existing cokers also requires extensive vessel fabrication work.

Hahn & Clay, *FACT Closure Installation, Operation, and Maintenance Manual*, May 1991, describes a closure device for coke drum unheading operations. A conventional bottom head is replaced with a custom head drilled for thirty-two bolts. The head is assembled as a sandwich with another flange or force ring of the same size as the bottom head. The head and force ring are assembled with a series of ramps located along the perimeter of the head. The assembly is held in place by the bolts and high nitrogen pressure is applied to a special force actuator located between the flanges to move them apart. Then a set of three hydraulic cylinders turn a special ramp ring to push the head upwardly from the force ring flange to hold the head in a pressurized position after the nitrogen pressure is removed. While suitable for remote operation, this device also cannot effectively deal with shot coke, is relatively complicated and cannot be easily retrofit on existing equipment.

U.S. Pat. Nos. 5,228,825 to Fruchtbaum et al. and 5,294,157 to Smith et al. disclose a coke drum deheading device which has springs and hooks with a retaining element to automate the head removal/replacement process. While a significant improvement over the other deheading devices, these disclosures do not address the handling of shot coke.

Consequently, there is a need for a delayed coker unheading device which can facilitate the performance of necessary service without exposing personnel to the danger of falling coke, and provide for capture of falling coke or other debris to maintain operability in the event of shot-coke cave-in. Further, the device should be relatively easily retrofitted on existing equipment and simple to operate and maintain.

SUMMARY OF THE INVENTION

A coker unheading device of the present invention retracts and tilts the bottom head incrementally so that falling debris such as shot cake can be caught by a chute. Following disposal of the loose debris, the head can be withdrawn from the area of the drum for maintenance. The present device can be advantageously retrofit to existing coke drums without extensive vessel modification since the head tilting mechanism can be supported entirely on the head lowering member. In addition, the present coker unheading device is simple to operate and maintain.

In one aspect, the present invention provides an unheading device for removing a bottom head from a flange on a lower end of a vessel filled with a bulk material, liquid or slurry. As one element, the present device comprises a car which is horizontally movable into position below the bottom head. As another element, a support member is mounted on the car for pivotably engaging a bearing element against a lower surface of the head. The support member is vertically retractable to different elevations to disengage the head from the flange. Means are provided for pivoting the bearing element and head from horizontal. The pivoting means are preferably mounted on and supported by the bearing element and/or support member. A plurality of spring-biased wheels are preferably provided for rollably supporting the car on a surface. A plurality of lugs are preferably provided for engaging a bearing surface for supporting the car thereon to avoid overloading the wheels when the car descends in reaction to a load on the car. A car-mounted chute operative with the support member and pivoting means is preferably provided for receiving and directing material falling through the flange from the vessel to an opening in a floor below the vessel. Preferably, the bearing element comprises a bearing plate and the pivoting means comprises a retractable arm having a first end attached to the bearing plate and a second end secured to the support member for pivoting the bearing plate by retracting and extending the arm. Alternatively, the pivoting means can include any mechanism suitable for pivoting the bearing plate with respect to the support member, such as an electric, hydraulic or pneumatic motor mounted on the support member to operate an arm attached to the bearing plate, a chain or belt operative with a sprocket or sheaf mounted to the bearing plate, directly or reducer-coupled, or the like.

In a preferred embodiment, the present invention provides an unheading device for removing a bottom head from a flange on a lower end of a coke drum. An unheading car is horizontally movable into and from position below the bottom head. A vertically adjustable bottom head support member is mounted on the car. A bearing plate is pivotably mounted at an upper end of the support member for engaging a lower surface of the bottom head. A retractable arm has first and second sections hingedly connected at one end and having respective opposite ends secured to the bearing plate and the support member for pivoting the bearing plate and bottom head supported thereon with respect to horizontal, preferably to tilt the head towards an adjacent chute. A plurality of spring-biased wheels are provided for rollably supporting the car on a surface. A plurality of lugs are provided for engaging a bearing surface for supporting the car thereon to avoid overloading the wheels when the car descends in reaction to a load on the car. A car-mounted chute operative with the support member, bearing plate, retractable arm and bottom head is provided to receive and direct material falling through the flange from the vessel to an opening in a floor below the vessel.

A mechanical stop or limit switch can be provided for horizontally aligning the unheading car with the bottom head assembled to the lower flange. A guide and recess in interengagement between the lower surface of the head and the bearing plate are preferably provided for locking the head in position laterally against the bearing plate. An interrupt switch is preferably provided for inhibiting upward movement of the bottom head support member when the bearing plate is pivoted from horizontal. The chute is preferably mounted on a chute car rollable on a pair of rails. A hitch is preferably provided for towing the chute car with the unheading car. The hitch is preferably connected to the retractable arm to move the chute car horizontally with respect to the unheading car when the bearing plate is pivoted. A mechanical stop or a limit switch is preferably provided for horizontally aligning the chute car with respect to the lower flange. The first section of the retractable arm preferably includes a cylinder, one end of the first section is hingedly secured to a rigid member extending downwardly from the bearing plate, and one end of the second section is hingedly secured to the bottom head support member. The first section of the retractable arm is generally horizontal when the bearing plate is in a horizontal attitude.

In another aspect, the present invention provides a method for unheading a lower flange of a coke drum. As one step, an unheading car having downwardly depending lugs and a spring cluster connection to wheels on rails is horizontally moved into position below an assembly of the flange and bottom head. A support member mounted on the unheading car is vertically extended to raise a bearing plate on an upper end thereof into engagement with a lower surface of the bottom head. A car-mounted chute below the coke drum is moved horizontally adjacent the head. The bottom head is disassembled from the flange. Any downward deflection of the unheading car is absorbed in the spring cluster connection of the wheels to a limit defined by engagement of the lugs on a bearing surface, and any additional load on the unheading car is transmitted to the bearing surface via the lugs. The support member is vertically retracted to lower the bearing plate and bottom head from the flange. The bottom head is pivoted with the bearing plate on the support member toward the chute to discharge loose material from an upper surface of the head into the chute. The unheading car is horizontally moved on the rails until the bottom head on the bearing plate is away from beneath the flange. The chute is moved horizontally into position below the flange to catch any material falling therefrom.

In a preferred embodiment of the method, horizontal movement of the unheading car can be stopped in position below the assembly by engaging a mechanical stop. Alternatively, horizontal movement of the unheading car can be stopped in position below the assembly when a position sensor indicates alignment of the unheading car relative to the assembly. The bearing plate and the bottom head can be aligned by interengagement of a guide and recess formed therebetween. Upward movement of the support member is preferably inhibited when the bearing plate is pivoted from horizontal. A chute car can be hooked to the unheading car and the chute car can be simultaneously moved in tow by horizontal movement of the unheading car. The chute car is preferably simultaneously moved horizontally toward the unheading car with the pivoting of the bottom head. Horizontal movement of the unheading car away from beneath the flange and of the chute car in position below the flange is preferably simultaneously stopped by engaging a mechanical stop or a position sensor.

Preferably, the vertical retraction step is continued until the pivoting step can be completed, and the pivoting step is preferably continued until the step of moving the unheading car away from the flange can be completed. Alternatively, the vertical retraction step is preferably continued until the bearing plate is at a predetermined elevation with respect to the unheading car, and the pivoting step is preferably continued until the bearing plate is at a predetermined angle with respect to horizontal.

DETAILED DESCRIPTION OF THE INVENTION

Figure 1:
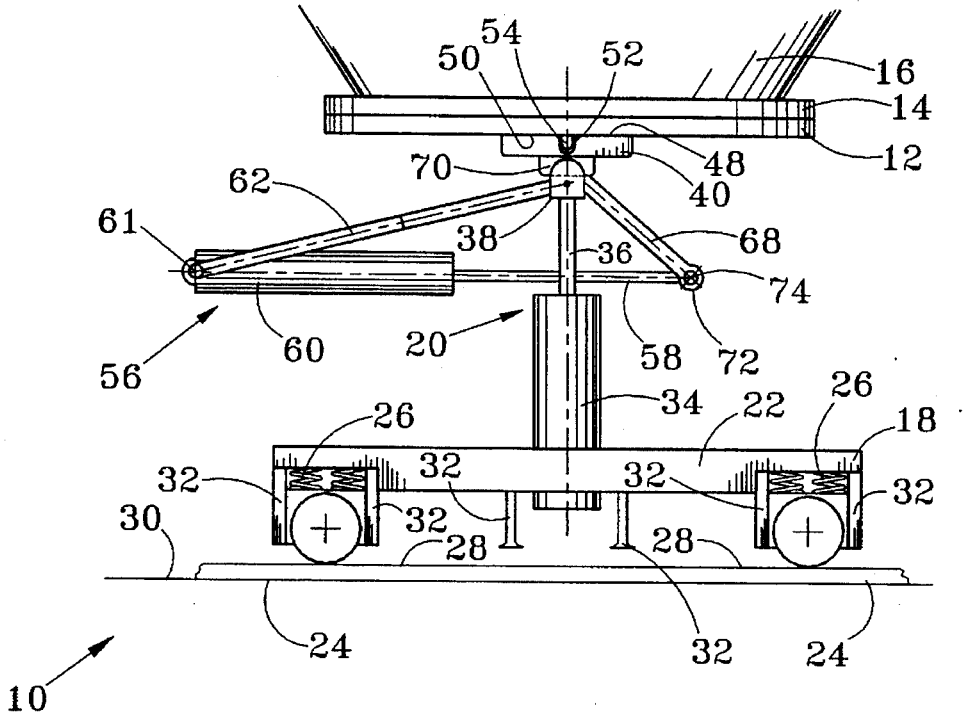
FIG. 1 is a side elevation of one embodiment of the unheading device of the present invention positioned below a closed vessel showing a vertical support member having a bearing plate engaging a bottom head.

A delayed coker bottom head is remotely lowered and pivoted by a mobile unheading device of the present invention to capture any shot coke or other debris through a chute. The head can then be withdrawn laterally to reduce the hazard posed by falling coke during maintenance thereof.

Referring to FIGS. 1–7, wherein like numerals reference like parts, there is shown a mobile unheading device 10 of the present invention suitable for retracting a bottom head 12 assembled to a lower flange 14 of a vertically oriented vessel 16. The device 10 is especially useful for unheading a coke drum as conventionally employed in a petroleum refinery, but can be used to unhead other types of vessels containing a liquid, slurry, bulk material, unconsolidated debris or the like. Various means are known for connecting the head 12 to the lower flange 14 including both manual and automatic operated clamps and/or bolts (not shown).

The unheading device 10 comprises a car 18 having mounted thereon one or more vertical support members 20 extendable into load bearing engagement with the bottom head 12. The car 18 includes a frame 22 having a plurality of spring biased wheels 24 mounted via spring clusters 26. The wheels 24 rollably support the car 18 on a surface preferably comprising a rail or track 28 to facilitate suitable alignment with the vessel 16. The rail 28 can be on a floor 30 below the car 18, or alternatively disposed overhead (not shown). When the rails are overhead, the frame 22 would be suspended from crooks (not shown) having an upper end mounting the wheels 24 and spring clusters 26 on the overhead rail. The wheels 24 in either bottom or top wheel design are biased by the spring clusters 26 to limit load bearing thereon. A plurality of load bearing lugs 32 depend from the frame 22. When the frame 22 descends in reaction to a load on the car 18 the spring clusters 26 are initially compressed, and then the lugs 32 engage a load bearing surface, such as, for example, the floor 30 or the rail 28 mounted on the floor 30. In this manner, excessive loads which would otherwise fall on the wheels 24 are instead transferred to a vessel support superstructure via the frame 22, the lugs 32 and the load bearing surface. The car 18 can be powered for horizontal movement along the rail 28 by electric, pneumatic, hydraulic or like drives well known in the art.

Figure 5:
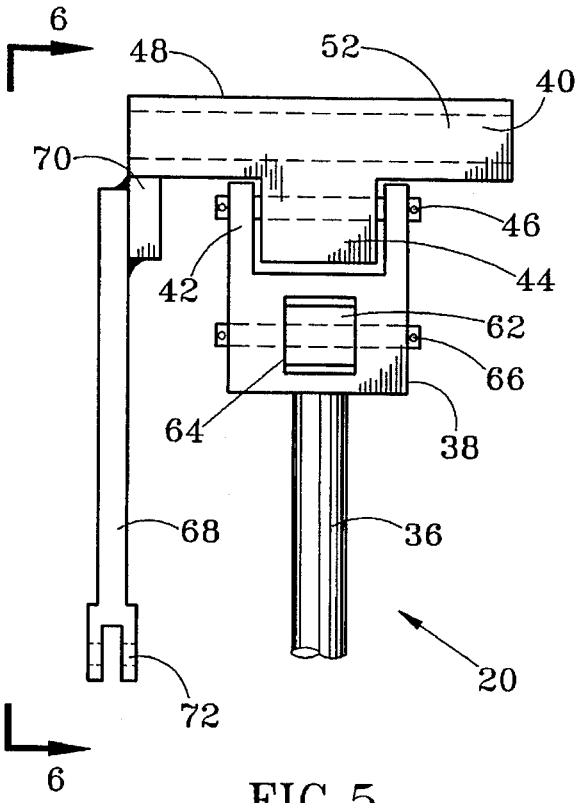
FIG. 5 is an end view of the connection of the bearing plate of FIG. 1 to the support member.

The vertical support members 20 preferably include an upright cylinder 34 secured at a lower end to the frame 22, and an extendable arm 36 which terminates in a coupling 38 pivotably secured at an upper end thereof to bearing plate 40. The arm 36 is typically operated via a conventional plunger (not shown) slidable with the cylinder 34 and a conventional hydraulic, pneumatic, mechanical or like drive (not shown) to adjust the vertical height of the bearing plate 40. As best seen in FIG. 5, the coupling 38 includes opposing jaws 42 which extend on either side of an ear 44 projecting downwardly from a lower surface of the bearing plate 40. A shaft 46 is disposed in a bore formed through the jaws 42 and the ear 44 to allow the bearing plate 40 to pivot with respect to the support member 20.

The bearing plate 40 (see FIGS. 5–7) has a generally flat upper surface 48 for engagement with a lower surface 50 of the head 12 for support thereof. A recess and guide are preferably formed for interengagement between the surfaces 48 and 50 to facilitate alignment of the bearing plate 40 with the head 12. For example, a central slot 52 can be formed longitudinally in the surface 48 to serve as the recess, and a bar 54 can be attached to the surface 50 as a guide. The slot 52 and bar 54 generally have a matching "V" or "U" shaped transverse cross-section which allows for some initial misalignment as the surfaces 48 and 50 are brought together. When the surfaces 48 and 50 are in abutment in a horizontal attitude, an axis of the shaft 46 and centerlines of the head 12, support member 20, slot 52 and bar 54 are generally in a common plane with the weight of the head 12 distributed about evenly on either side thereof. The guide-and-recess interengagement between slot 52 and bar 54 inhibits lateral movement of the head 12 with respect to the bearing plate 40 during pivoting thereof about the axis of the shaft 46.

An arm 56 is preferably provided for pivoting the bearing plate 40 and tilting the head 12. The arm 56 has a first end attached at any convenient anchor point spaced away from the shaft 46, and a second end attached to the bearing plate 40 at an attachment point spaced from the shaft 46. Pivoting of the bearing plate 40 about the axis of the shaft 46 is effected by extending and retracting the arm 56 to adjust the distance between the anchor point to the attachment point. Alternatively, the bearing plate 40 can be pivoted by an electric, hydraulic or pneumatic motor (not shown) mounted on the arm 36 and operatively coupled to the bearing plate 40, for example, directly or indirectly via a chain or belt power transmission, with or without gear reduction.

Figure 2:
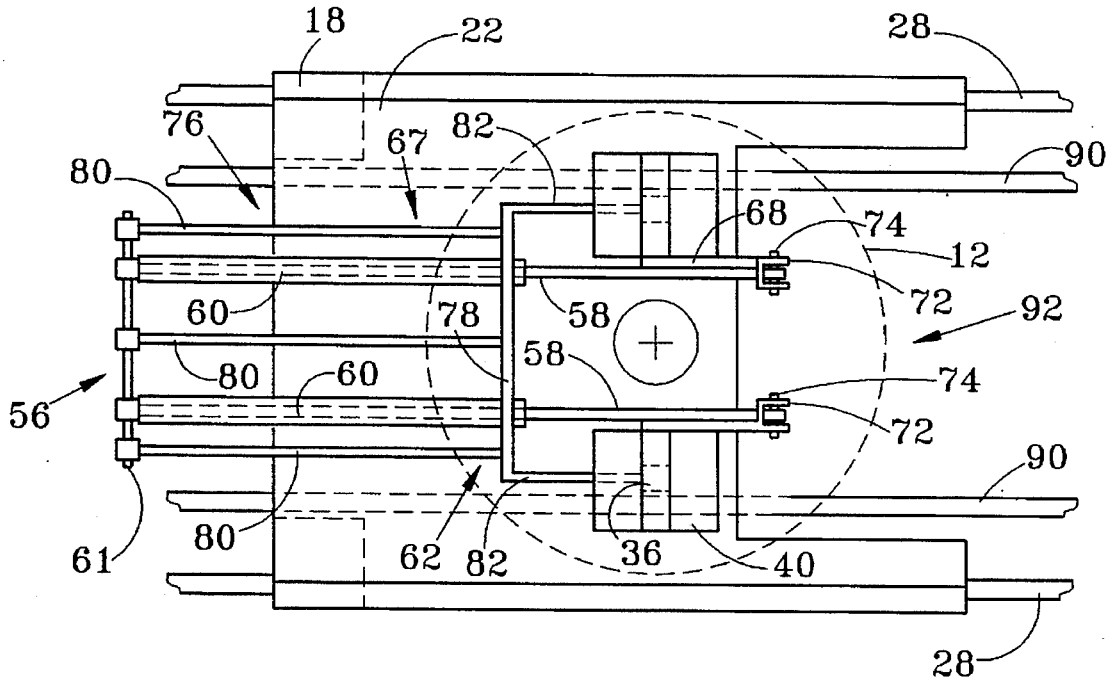
FIG. 2 is a top plan of the unheading device of FIG. 1 positioned below a closed vessel showing the orientation of a pair of horizontally retractable arms.
Figure 3:
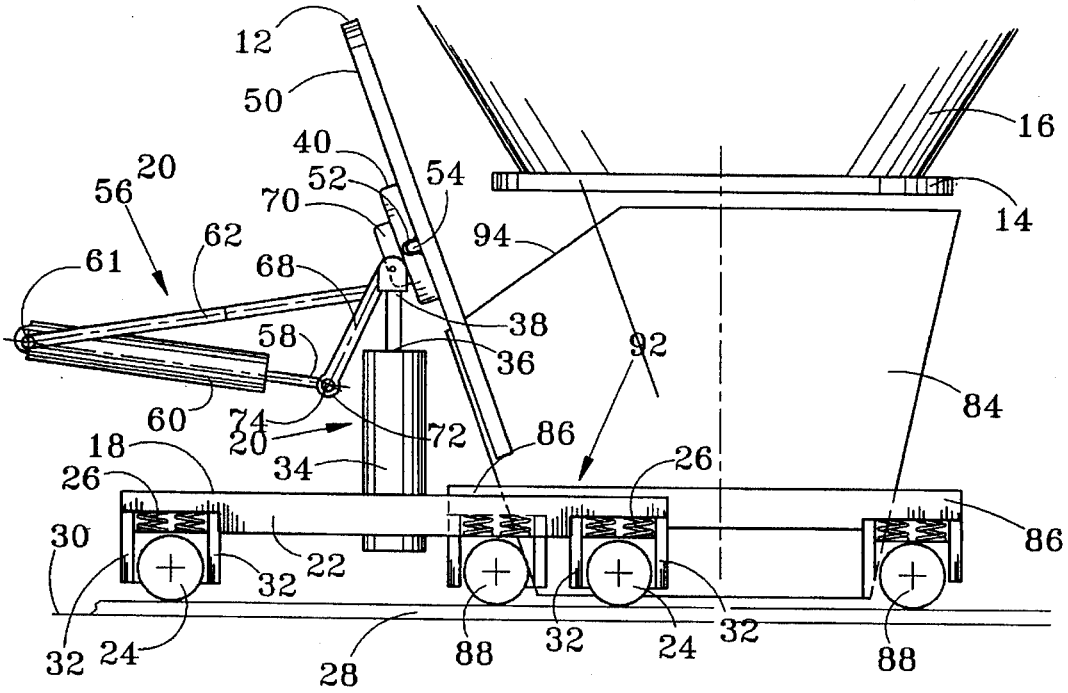
FIG. 3 is a side elevation of the unheading device of FIG. 1 positioned to the side of an open vessel following an unheading operation showing the bottom head pivoted on the bearing plates and a chute car positioned below the vessel.
Figure 7:
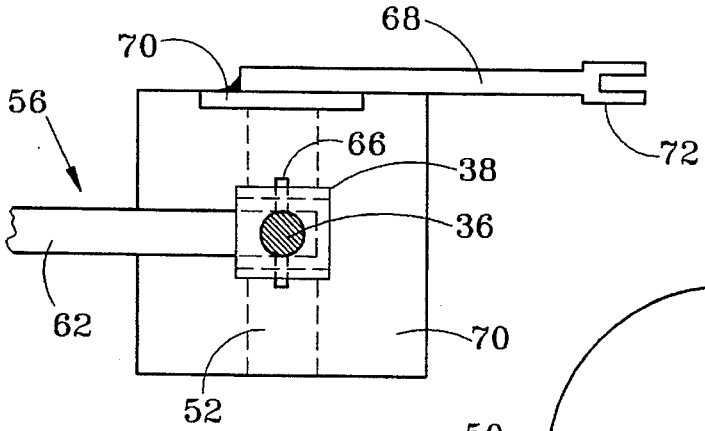
FIG. 7 is a bottom view of the bearing plate along the lines 7—7 in FIG. 6.
Figure 4:
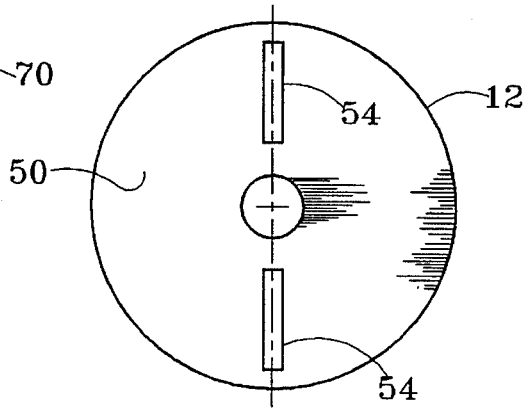
FIG. 4 is a bottom view of the bottom head of FIGS. 1–3.
Figure 6:
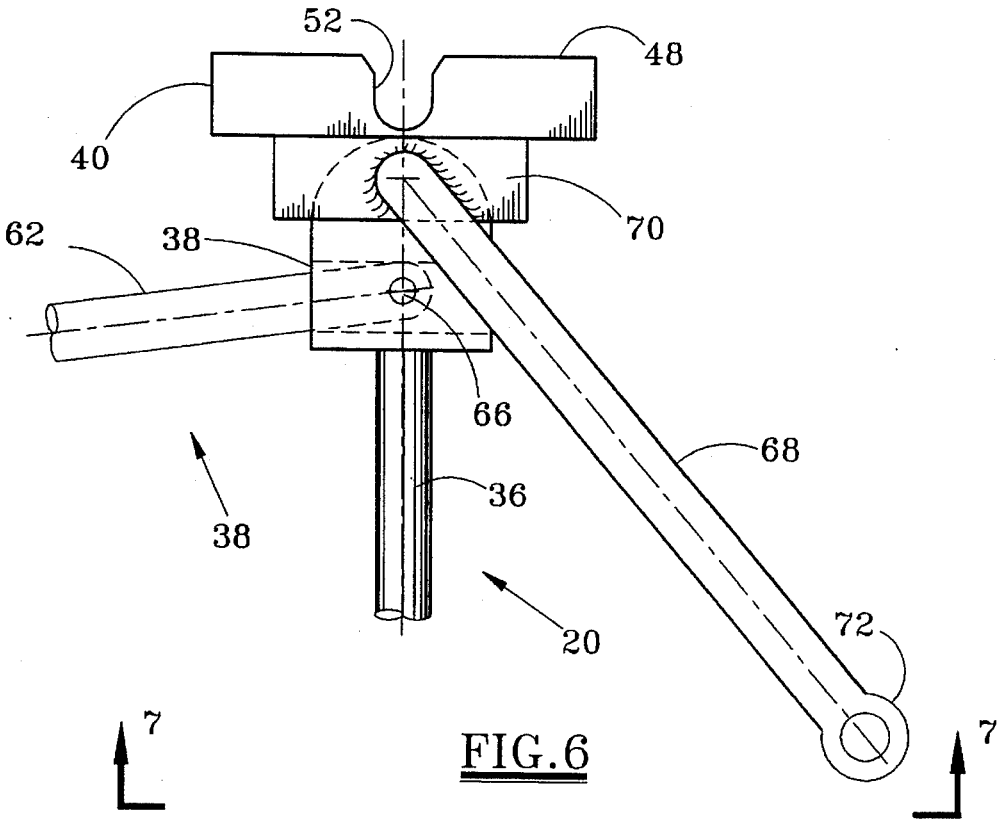
FIG. 6 is a side view of the bearing plate along the lines 6—6 in FIG. 5 showing a coupling element.

In the embodiment illustrated in FIGS. 1–3 and 5–7, the anchor point from the arm 56 is at the coupling 38. The arm 56 has a retractable member 58 operable by a cylinder 60 hingedly connected on a common shaft 61 to one end of a traverse 62. Although a cylinder 60 is illustrated, it is understood that an electric, hydraulic or pneumatic motor (not shown) could similarly be used to operate the arm 56 by direct or indirect coupling thereto. As best seen in FIGS. 5–7, the other end of the traverse 62 is received in a slot 64 formed in the coupling 38 below the jaws 42, and is pivotably secured therein by a pin 66 which passes through a transverse bore formed adjacent the slot 64 and through the end of the traverse 62. The retractable member ,58 has an end pivotably connected to a rigid arm 68 extending downwardly from the bearing plate 40 at an angle of approximately 45° from a plane defined by the surface 48. The rigid arm 68 is secured to a mounting bracket 70 depending from the bearing plate 40, by, for example, welding, bolts or the like. The arm 68 terminates in opposing jaws 72 on either side of the member 58 received thereby. A pin 74 passes through the jaws 72 and the member 58 and provides a pivot point between the member 58 and the rigid arm 68. The position of the shaft 61 and pin 74 are preferably such that the cylinder 60 remains approximately horizontal during extension and retraction of the member 58. The cylinder 60 preferably has a hydraulically, pneumatically or mechanically operable plunger as is well known in the art for retracting and extending the member 58. The retraction of the member 58 pivots the bearing plate 40 with the head 12 resting thereon about the shaft 46. The head 12 can be generally pivoted at an angle of up to about 60–70 degrees from horizontal as best seen in FIG. 3.

As best seen in FIG. 2, the unheading device 10 preferably employs a pair of the vertical support members 20 and respective bearing plates 40 for pivotably engaging the bottom head 12 on either side thereof for added stability. A corresponding pair of retractable arms 56 each include a respective member 58 and cylinder 60 hingedly secured at the pins 74 and the shaft 61. The traverse 62 is provided in the form of a carriage 76 including a crosspiece 78, a plurality of laterally spaced beams 80 extending from the crosspiece 78 to the shaft 61, and a pair of laterally spaced beams 82 extending from the crosspiece 78 to the respective pins 66. The members 58 and beams 82 should be laterally spaced apart to allow clearance around any piping or other projection conventionally employed at the center of the head 12.

The device 10 preferably includes, in combination, an independent, mobile chute 84 having a generally conical configuration as seen in FIG. 3. The chute 84 is preferably mounted on a car 86 having wheels 88 which roll on a pair of tracks or rails 90 inside the track 28 (see FIGS. 2 and 3) to facilitate positioning of the chute 84 below the lower flange 14 when the head 12 is pivoted. The unheading car 18 preferably has an opening 92 formed in the frame 22 for receiving a front end of the chute car 86 (see FIG. 3). The chute car 86 can be independently powered by an electric, hydraulic or pneumatic drive (not shown). Alternatively, the chute car 86 includes a hook (not shown) which is hitched to the unheading car 18 for simultaneously moving the chute car 86 in tow by horizontal movement of the unheading car 18. The chute car 86 is preferably hitched to the member 58 so that the chute car 86 can be moved horizontally toward the unheading car 18 simultaneously with the pivoting of the bottom head 12. In such a manner, the chute car 86 can be positioned under the opened vessel 16 prior to any lateral movement of the unheading car 18. The chute 84 preferably has a beveled lip 94 to permit pivoting of the head 12 toward the chute 84 without interference during the unheading operation. The chute 80 is then positioned below the partially opened head 12 to funnel material from the vessel 16 into an opening in the floor 30, e.g. to a processing receptacle or disposal line (not shown).

Retraction of the retractable members 36, 58 as well as lateral movement of the car 18 can be adjusted using adjustable force controllers (not shown) so that all the actions of the present unheading device 10 can be synchronized. The force controllers have programmed responses depending on a measurement of a force exerted. For example, if the exerted force of the cylinders 60 exceeds a certain setpoint (caused, for instance, by the vessel wall or debris interfering with pivoting the head 12), retraction of the vertical cylinders 34 commences or continues and/or the unheading car 18 is concurrently moved laterally (if lugs 32 are not engaging the track 28) to establish a clearance for the pivoting head 12. When the force controllers on the cylinders 60 detect an exerted force below a setpoint, the retraction is commenced and the vertical retraction by the cylinders 34 and/or the lateral positioning of the car 18 ceases. Thus, the three actions of the unheading device 10 can be synchronized for a smooth pivoting and lateral removal of the head 12 from the vicinity of the flange 14.

When it is desired to unhead a vessel 16 such as a coke drum which has been taken out of service for maintenance purposes, the unheading device 10 of the present invention is rolled into position below the head assembly. A travel limit switch or mechanical stop (now shown) can be used to facilitate alignment of the car 18 under the assembly. The vertical support members 20 are actuated to elevate the bearing plates 40 and seat the bars 54 in the slots 52. The vertical lifting force is preferably interlocked with the position of the cylinder 60 to ensure that the horizontal attitude of the bearing plates 40 corresponds to the horizontal position of the head 12. Elevation of the bearing plates 40 is halted by mechanical contact with the head 12 via position limit switches or force limit switches.

With the bearing plates 40 engaged, operations personnel can detach connecting bolts (or other connecting means) for disassembling the head 12 from the lower flange 14. Any load on the head 12 from material in the vessel 16 (e.g. from shot coke) will deflect the car downwardly, compressing the spring clusters 26 and causing the lugs 32 to descend into engagement with the rail 28. To counteract the deflecting force, upward force imparted by the vertical support members 20 is increased to prevent leaks from the disassembled head 12. At this point of the unheading operation, the chute car 86 can be hitched to the unheading car 18.

The head 12 is initially lowered from the flange 14 by retracting the vertically retractable members 36 into the cylinders 34. The head 12 is then pivoted by retracting the members 58 into the cylinders 60, and preferably the unheading car 18 is simultaneously moved laterally. In either automatic or manual operation, the use of force control permits the operation to be synchronized. The head 12 is preferably lowered until the force exerted by the cylinders 60 is sufficient to continue the pivoting action (i.e. the vessel flange does not interfere with the pivoting action). When the pivoting force exerted is not sufficient (e.g. due to flange interference or debris), the vertical retracting action commences. When the exerted pivoting force is sufficient (e.g. when there is no flange interference), the horizontal retracting force commences.

Concurrently, the unheading car 18 is moved incrementally laterally from underneath the vessel 16 and simultaneously moves the chute car 86 under the partially open head 12. When the unheading car 18 cannot be moved (due to the descent of the lugs 32 and/or debris lodged between the head 12 and the flange 14), the pivoting force continues until sufficient contents from the vessel 16 resting on an upper surface of the head 12 have been emptied and the unheading car 18 can be moved. A travel limit switch or mechanical stop (not shown) are preferably used to halt the lateral movement of the unheading car 18 when the chute car 86 is directly below the vessel 16.

Once any loose contents of the vessel 16 are substantially emptied, the unheading car 18 can be moved, and the chute 84 can also be rolled into position. The head 12, once completely moved horizontally away from under the flange 14, can be cleaned up by maintenance personnel at a location remote from the vessel 16 in preparation for a head 12 replacing operation. The car 18 can also be used during maintenance to pivot the head 12 as desired to facilitate maintenance and cleaning thereof.

When it is desired to replace the head assembly of the vessel 16 prior to bringing the vessel 16 back into service, the head 12 is pivoted into a horizontal orientation by operating the cylinder 60, if needed, and the car 18 is operated to reposition the head 12 below the vessel 16. Next, the arms 36 are extended from the cylinders 34 to elevate the bearing plates 40 to raise the head 12 into mating engagement with the lower flange 14. Bolts or other closure means are then replaced and tightened. The bearing plates 40 are disengaged by retracting the arms 36 into the cylinders 34, and the car 18 can be moved away from beneath the head assembly.

Operation of the unheading device 10 is preferably controlled from a remote location so that the unheading process can be made substantially automatic to limit exposure of maintenance personnel.

Figure 8:
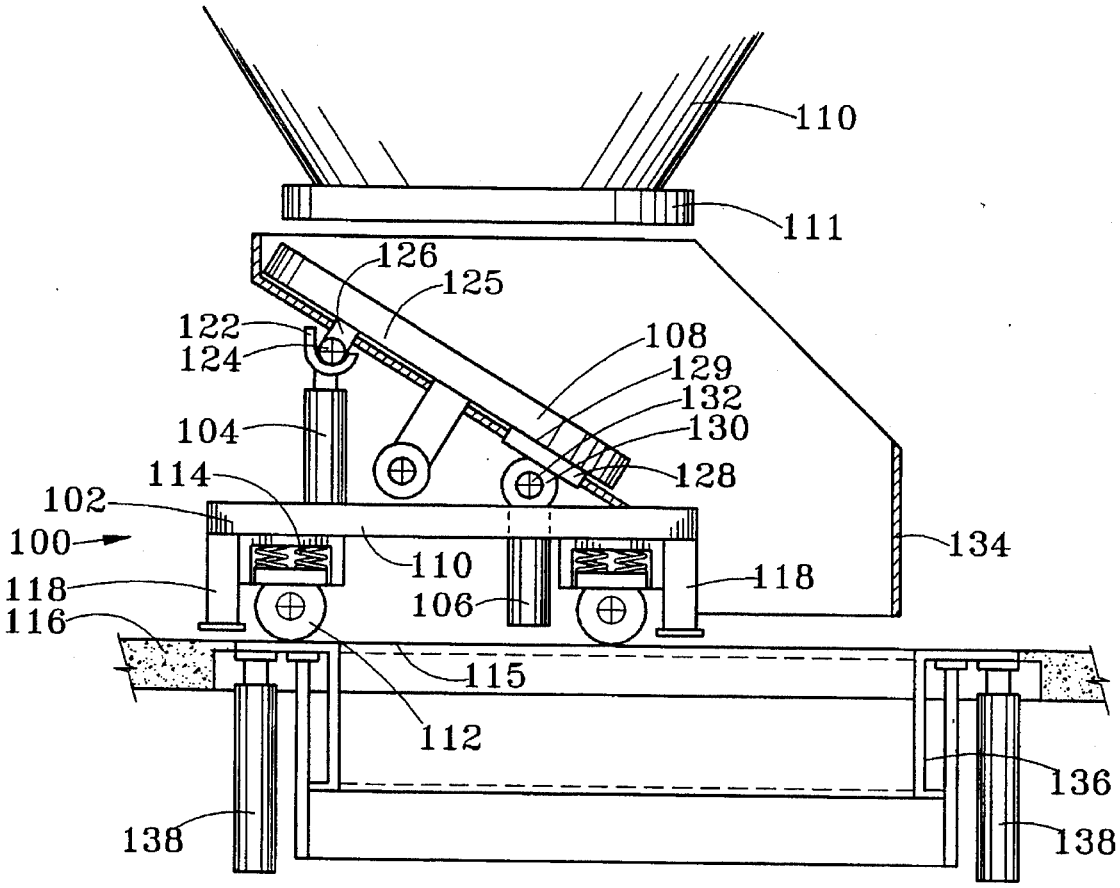
FIG. 8 is a side elevation of another embodiment of the present unheading device positioned below a partially open vessel showing parallel vertical support members mounted in a car, the support members having different elevations to pivotably rotate the head, and also showing a chute mounted in the car.

FIG. 8 illustrates another embodiment of the present invention. An unheading device 100 comprises a car 102 supporting one or more pairs of vertically retractable support members 104, 106 which engage a bottom head 108 attached to a vessel 110 by a lower flange 111 for pivotably retracting the head 108 in a unheading operation.

Similar in design to the car 18, the car 102 includes a frame 110 having a plurality of spring-biased wheels 112 similar to wheels 24 in FIGS. 1–7. The wheels 112 rollably support the car 102 on a bearing surface 115 such as a rail or track attached to a floor 116 to facilitate alignment. A plurality of load bearing lugs 118 depending from the frame 110 descend with the car 102 in reaction to a load on the car 102 compressing springs 114. The lugs 118 engage the bearing surface 115 transferring excessive loads away from the wheels 112 to a vessel support superstructure (not shown).

The vertical support members 104, 106 are vertically positionable with respect to the car frame 110 by an elevator mechanism (not shown) disposed therein. The design and operation of such elevators is well known in the art. Alternatively the arms 104, 106 can comprise a load bearing cylinder (not shown) having a cylinder body securely affixed to the car frame 110 and a vertically retractable, force imparting plunger for engaging the head 102, wherein the plunger is hydraulically, pneumatically or mechanically actuated.

To pivotably retract the head 102 according to this embodiment of the present invention, the support members 104, 106 pivotably engage the head 102 at a distance spaced from a centerline. By establishing an elevational difference between the support members 104, 106, the head 102 is pivoted with respect to horizontal.

The support member 104 includes a "C" shaped pivot housing 122 fixedly secured to an upper end thereof for seating an elongated cylindrical pivot element 124 secured to a head bottom surface 125 by a bar 126. The support member 106 includes a bearing plate 128 hingedly connected to an upper end thereof. The plate 128 includes an upper slide surface 129 for slidably engaging the head bottom surface 125 when the head 108 is pivoted. The bearing plate 128 is hinged to the support member 106 by a hinge 130 receiving a shaft 132. It can be seen that when the head 108 is pivoted open by lowering the elevation of the support member 106 with respect to the support member 104, the bearing plate 128 pivots to maintain seating thereof on the head bottom surface 125. Concurrently, the plate 128 slides incrementally toward the head centerline.

When it is desired to unhead a vessel 110 such as a coke drum which has been removed from service for maintenance purposes, the unheading device 100 of the present invention is rolled into position below the head assembly. The support members 104, 106 are elevated to seat the pivot element 124 in the pivot housing 122 and the bearing plate t28 against the head bottom surface 125. The head 108 is disassembled from the flange 111 and, if necessary, the support members 104, 106 are then further raised to impart sufficient force to maintain closure. Concurrently, the load from the head 108 is transferred to the superstructure via the car lugs 118. The disassembled head 108 is gradually lowered by retracting the support members 104, 106 and then pivoted by further retracting the support member 106. The head 108 can then be transported away from underneath the lower flange 111 to conduct maintenance.

The car 102 preferably has mounted thereon a chute 134 which is suitable for capturing the coke particles or other debris as the head 108 is cracked open. The debris is directed to a floor chute 136 for disposal or other processing. Once the free debris is dealt with, the car 102 can be transported away and the chute 136 can be raised to engage the vessel lower flange 111 during the vessel cleaning operation. The chute 136 is raised and lowered by cylinders 138.

When it is desired to rehead the vessel 110 and bring it back into service, the chute 136 is lowered and the car 102 is rolled into alignment under the head 108. The support members 104, 106 are elevated and the head 108 is reassembled to the lower flange 111. The support members 104, 106 are then disengaged and the car 102 can be transported away from beneath the head assembly.

The present coke drum unheading device and method are illustrated by way of the foregoing description and examples. The foregoing description is intended as a non-limiting illustration, since many variations will become apparent to those skilled in the art in view thereof. It is intended that all such variations within the scope and spirit of the appended claims be embraced thereby.

We claim:

1. An unheading device for removing a bottom head from a flange on a lower end of a coke drum, comprising:

a car horizontally movable into and from position below the bottom head;

a vertically adjustable bottom head support member mounted on the car; a bearing plate pivotably mounted at an upper end of the support member for engaging a lower surface of the bottom head;

a retractable arm having first and second sections hingedly connected at one end and having respective opposite ends secured to the bearing plate and the support member for pivoting the bearing plate and bottom head supported thereon with respect to horizontal;

a plurality of spring-biased wheels for rollably supporting the car on a surface;

a plurality of lugs for engaging a bearing surface for supporting the car thereon to avoid overloading the wheels when the car descends in reaction to a load on the car;

a car-mounted chute operative with the support member, bearing plate, retractable arm and bottom head to receive and direct material falling through the flange from the coke drum to an opening in a floor below the coke drum.

2. The device of claim 1, comprising a mechanical stop for horizontally aligning the car with the bottom head assembled to the lower flange.

3. The device of claim 1, comprising a limit switch for horizontally aligning the car with the bottom head assembled to the lower flange.

4. The device of claim 1, comprising a guide and recess in interengagement between the lower surface of the bottom head and the bearing plate for locking the bottom head in position laterally against the bearing plate.

5. The device of claim 1, comprising an interrupt switch for inhibiting upward movement of the bottom head support member when the bearing plate is pivoted from horizontal.

6. The device of claim 1, wherein the chute is mounted on a chute car rollable on a pair of rails.

7. The device of claim 6, comprising a hitch for towing the chute car with the car.

8. The device of claim 7, wherein the hitch is connected to the retractable arm to move the chute car horizontally with respect to the car when the bearing plate is pivoted.

9. The device of claim 7, comprising a mechanical stop for horizontally aligning the chute car with respect to the lower flange.

10. The device of claim 7, comprising a limit switch for horizontally aligning the chute car with respect to the lower flange.

11. The device of claim 1, wherein the first section of the retractable arm includes a cylinder, one end of the first section is hingedly secured to a rigid member extending downwardly from the bearing plate, and one end of the second section is hingedly secured to the bottom head support member.

12. The device of claim 11, wherein the first section of the retractable arm is generally horizontal when the bearing plate is in a horizontal attitude.

* * * * *